US007542702B2

(12) United States Patent
Saito et al.

(10) Patent No.: US 7,542,702 B2
(45) Date of Patent: Jun. 2, 2009

(54) IMAGE FORMING APPARATUS HAVING A SIMPLE CASSETTE OF IMAGE BEARING PHOTOCONDUCTORS

(75) Inventors: Masanori Saito, Tokyo (JP); Nobuyuki Yanagawa, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 429 days.

(21) Appl. No.: 11/359,617

(22) Filed: Feb. 23, 2006

(65) Prior Publication Data

US 2006/0204277 A1 Sep. 14, 2006

(30) Foreign Application Priority Data

Feb. 25, 2005 (JP) ..... 2005-050807

(51) Int. Cl.
*G03G 21/18* (2006.01)

(52) U.S. Cl. ..... 399/112; 399/113

(58) Field of Classification Search ..... 399/116, 399/299, 111–113, 117, 167, 306
See application file for complete search history.

(56) References Cited

U.S. PATENT DOCUMENTS

| | | | | |
|---|---|---|---|---|
| 6,198,891 | B1 * | 3/2001 | Ishida et al. | 399/117 |
| 6,381,428 | B1 * | 4/2002 | Yamamoto et al. | 399/116 |
| 6,580,888 | B2 * | 6/2003 | Horrall et al. | 399/119 |
| 6,674,982 | B2 | 1/2004 | Saitoh et al. | |
| 6,832,061 | B2 * | 12/2004 | Saito et al. | 399/111 |
| 6,944,415 | B2 * | 9/2005 | Nomura | 399/111 |
| 6,978,103 | B2 * | 12/2005 | Miura et al. | 399/116 |
| 7,340,199 | B2 * | 3/2008 | Ito et al. | 399/116 |
| 2004/0136747 | A1 | 7/2004 | Tanizaki et al. | |
| 2004/0165910 | A1 | 8/2004 | Sato et al. | |
| 2005/0002686 | A1 | 1/2005 | Saitoh et al. | |

FOREIGN PATENT DOCUMENTS

| | | | |
|---|---|---|---|
| EP | 1 345 087 | A2 | 9/2003 |
| JP | 2000-75733 | | 3/2000 |
| JP | 2002-108171 | | 4/2002 |
| JP | 2002108049 | A * | 4/2002 |
| JP | 2003-50531 | | 2/2003 |
| JP | 2004070088 | A * | 3/2004 |
| JP | 2004198676 | A * | 7/2004 |

OTHER PUBLICATIONS

Patent Abstracts of Japan, JP 09-166898, Jun. 24, 1997.

* cited by examiner

*Primary Examiner*—Robert Beatty
(74) *Attorney, Agent, or Firm*—Oblon, Spivak, McClelland, Maier & Neustadt, P.C.

(57) ABSTRACT

An image forming apparatus includes a plurality of image carrying members and an image carrier. Each of the plurality of image carrying members is configured to form and carry a toner image. The image carrier cassette is configured to be detachably installed to the image forming apparatus and includes an image carrier holder. The image carrier holder is configured to rotatably hold the plurality of image carrying members and to allow each of the plurality of image carrying members to be independently removed therefrom.

7 Claims, 11 Drawing Sheets

IMAGE FORMING APPARATUS HAVING A SIMPLE CASSETTE OF IMAGE BEARING PHOTOCONDUCTORS

BACKGROUND OF THE INVENTION

1. Field of the Invention

The present invention relates to an image forming apparatus, and more particularly to an image forming apparatus provided with a detachable image bearing cassette having plural image bearing members.

2. Description of the Related Art

Up to now, in the field of image forming apparatuses, there has been proposed a so-called process cartridge detachable to an image forming apparatus, which is manufactured by integrating a photosensitive member. Also, there has been proposed an image forming unit that integrates plural photosensitive members and another image forming mechanism and is detachable to an image forming apparatus main body.

The above process cartridge and image forming unit are advantageous in that a user can easily perform replacement and maintenance without the help of a specialist. However, in such structure that the photosensitive members and the image forming mechanism are integrated, the entire process cartridge and the entire image forming unit should be replaced even if a user desires to replace a part of the photosensitive members and the image forming mechanism. Worse yet, in the case of the image forming unit having plural short-life photosensitive members, if any one of the photosensitive members needs to be replaced, the entire unit should be replaced even though the remaining members are serviceable. With regard to a color printer having four photosensitive members, the life of a black photosensitive member expires sooner than photosensitive members of the other colors due to frequent use. Thus, in order to replace the black photosensitive member, the entire image forming unit including the photosensitive members of the other colors should be replaced.

Further, in the process cartridge, a container of a cleaning device for rotatably supporting a photosensitive member is integrated with the photosensitive member. The cleaning container is provided with a process mechanism for charging the photosensitive member to form an image. The process mechanism refers to a charging roller for uniformly charging the photosensitive member, and a cleaning blade and cleaning roller for scraping off residual toner that remains on the photosensitive member even after transferring a toner image onto a sheet-like medium (hereinafter referred to as "sheet"). These are provided around the photosensitive member. The process cartridge can be attached/removed to/from an image forming apparatus, and replaced by a user himself/herself at the end of its useful life or when waste toner is fully filled.

In addition, the image forming unit incorporates plural photosensitive members, charging rollers and developing devices corresponding to the individual photosensitive members, and plural intermediate transfer drums as main components. The unit can be inserted/removed to/from the image forming apparatus, and replaced by the user himself/herself at the end of the useful life of the photosensitive members or intermediate transfer drums.

Meanwhile, there has been known a two-station recording system. In this two-station recording system, a developing device, a writing device, and a driving mechanism are supported to an apparatus main body via a common assembly member, and are positioned with high accuracy. According to such structure, the developing device is positioned relative to the apparatus main body and thus used as a reference position (assembly reference) for all components of an image forming process. The photosensitive member (or photosensitive unit) is incorporated into the developing device, not the apparatus main body. That is, the photosensitive member (or photosensitive unit) is positioned only relative to the developing device, so a relationship between the developing device and the photosensitive member (or photosensitive unit) is a master-servant relationship. The photosensitive member (or photosensitive unit) is detachable to the developing device, and the developing device is detachable to the image forming apparatus. Further, the photosensitive drum, the charging mechanism, and the cleaning mechanism are integrated together.

In recent years, stringent market requirements have been imposed on an image forming apparatus such as a printer or a copier. Accordingly, an image forming unit has become more important. Furthermore, it is known that the market requirements place importance on the photosensitive member out of the image forming mechanism. A detailed description thereof is given below from the viewpoints of three factors.

A first factor is reduction in diameter in photosensitive member accompanying downsizing of image forming apparatus. In recent years, market requirements have been directed toward downsizing an office machine, and accordingly, a downsizing is required of an image forming unit. However, if a drum-like photosensitive member as an image bearing member is reduced in size, that is, in diameter, a wearing degree per sheet is increased under the same image forming conditions. For example, assuming that the photosensitive diameter is reduced from 120 mm to 40 mm, the 40-mm photosensitive member needs to rotate at a speed three times higher than that of the 120-mm photosensitive member in order to form an image of the same size. This trebles various types of wearing of a photosensitive member upon image formation, such as an electrical wearing due to discharge etc. in a charging unit or a mechanical wearing due to a blade in a cleaning unit. Hitherto, a developing device or other such devices have been downsized to some degree. However, size reduction of a photosensitive member has not been pursued as actively as other image forming units, from the viewpoint of avoiding the above wearing. Nevertheless, it is inevitable that the photosensitive member will be downsized to meet an increasing requirement for size reduction. As mentioned above, the requirement for size reduction places much weight on the photosensitive member and shortens its useful life.

A second factor is slimness of photosensitive member along with high image quality. In recent years, users have output photographic images or graphic documents more than before. Accordingly, an attempt to increase an image quality up to a film image has been made. A typical way to increase the image quality is increasing a resolution. However, a slim photosensitive member is required for increasing the resolution in an electrophotographic process. For example, in a negatively-charged photosensitive member, carriers generated in a CGL (charge carrier generation layer) pass through a CTL (charge carrier transport layer) to reach the photosensitive member surface to thereby form a latent image on the photosensitive member. If the CLT is thick in this case, the carriers should move for a long distance, with the result that the carriers are separated from one another due to electrical repulsion between the carriers. If so, a latent image corresponding to a writing signal cannot be formed, resulting in an image dot positions of which are a little incorrect. As a result, an image quality is deteriorated. This problem arises not only in the case of increasing the resolution of the electrophotography from 600 dpi to 1200 dpi but also in the case of improving an image quality with the resolution kept at 600 dpi, for example, in order to meet recent requirements for high image quality. The photosensitive member should be made slim and the movement distance of carriers should be reduced for preventing the deterioration of image quality. To that end, recent photosensitive members are made thinner. However, the photosensitive member is worn, for example, worn away by a cleaning every image formation process. Thus, the life of a thinner photosensitive member expires after fewer image formation processes. This shortens the life of the photosensitive member.

A third factor is an increase in importance of photosensitive member along with rise in popularity of color image. In recent years, a popularity of a color image has risen on the market from the viewpoint of facilitating the understanding of information. Incidentally, as for a color image, a photographic image or a graphic image that would occupy a wide area of a recording sheet is printed out in many cases unlike a monochrome image which mainly includes character information. In addition, the background includes solid fills in many cases. Thus, an image formation area per image formation process increases, and accordingly, an image forming unit including the photosensitive member is worn more and more. Meanwhile, an image forming apparatus of a revolver type where plural developing devices correspond to one photosensitive member, for example, has been known. Such an image forming apparatus has been widely available on the market because the number of parts can be reduced and a color image can be formed with relatively low cost. However, latent images are developed onto the photosensitive member by plural developing devices for forming one color image, so the photosensitive member is worn at a speed several times higher than the developing devices. In the above image forming apparatus, a wearing of the photosensitive member accompanying the formation of color images is particularly conspicuous. As described above, the formation of color images is one of the factors that shorten the photosensitive member's life.

Based on the foregoing three factors of the downsizing, the high-quality image formation, and the color image formation, it is supposed that the photosensitive member be worn at higher speed than the other image forming unit. Needless to say, studies about how to improve the durability of the photosensitive member and how to lengthen its usable life have been under progress, but similar studies have been made on the other image forming unit. This means that the photosensitive member's life tends to become shorter than that of the other image forming unit.

This leads to an unbalanced relation in usable lifetime between the process cartridge or photosensitive member incorporated in the image forming unit and the other image forming mechanisms. That is, the conventional process cartridge or image forming unit faces a problem in that the process cartridge should be replaced with reference to an image forming mechanism having the shortest usable life. According as the photosensitive member's life is shortened, the above problem becomes noticeable. Hence, the other image forming mechanisms should be disadvantageously replaced with reference to the short-life photosensitive member. As regards the image forming unit, the unit is replaced with reference to a photosensitive member having the shortest life among the plural photosensitive members.

In such a circumstance, a serviceable image forming unit should be discarded or recycled to impose an economical burden on a user, wastefully expend a manufacturer's effort to recover units, and adversely affect the environment.

There has been proposed an image forming apparatus where a short-life component out of the components of image forming mechanisms is preferentially replaced to reduce the burdens on the user, the manufacturer, and the environment with a view to overcoming the drawbacks resulting from the recent market requirements. According to the image forming apparatus, the plural photosensitive members can be individually and replaced as a photosensitive cassette by a user. Hence, the apparatus can deal with even such a situation that a replacement timing varies between the photosensitive members.

SUMMARY OF THE INVENTION

In view of the foregoing, the present invention provide a novel image forming apparatus which improves a handling of attachment and detachment of photoconductive members. In one example, a novel image forming apparatus includes a plurality of image carrying members and an image carrier. Each of the plurality of image carrying members is configured to form and carry a toner image. The image carrier cassette is configured to be detachably installed to the image forming apparatus and includes an image carrier holder. The image carrier holder is configured to rotatably hold the plurality of image carrying members and to allow each of the plurality of image carrying members to be independently removed therefrom.

The above-mentioned image forming apparatus may further include a positioning mechanism configured to determine positions of driving members integrally mounted to and driving the plurality of image carrying members such that most eccentric points of the driving members are arranged at identical positions to match relative driving phases of the driving members.

The positioning mechanism may includes a sensor configured to detect marks provided to the driving members to indicate positions of the most eccentric points.

The image carrier cassette may allow each of the plurality of image carrying members to be independently removed therefrom and attached thereto under a condition that the image carrier cassette is installed in the image forming apparatus.

The above-mentioned image forming apparatus may further include a plurality of image forming components arranged at respective predetermined fixing positions around each one of the plurality of image carrying members.

The above-mentioned image carrier cassette may be removable from the image forming apparatus after at least one of the plurality of image forming components is moved away from the predetermined fixing position.

The above-mentioned image carrier cassette may allow each of the plurality of image carrying members to be independently removed therefrom and attached thereto under a condition that the image carrier cassette is in a state detached from the image forming apparatus.

The above-mentioned image carrier cassette may be reinstallable into the image forming apparatus under a condition that the at least one of the plurality of image forming components is moved away from the predetermined fixing position.

The above-mentioned at least one of the plurality of image forming components may be reset to the predetermined fixing position when the image carrier cassette is reinstalled into the image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
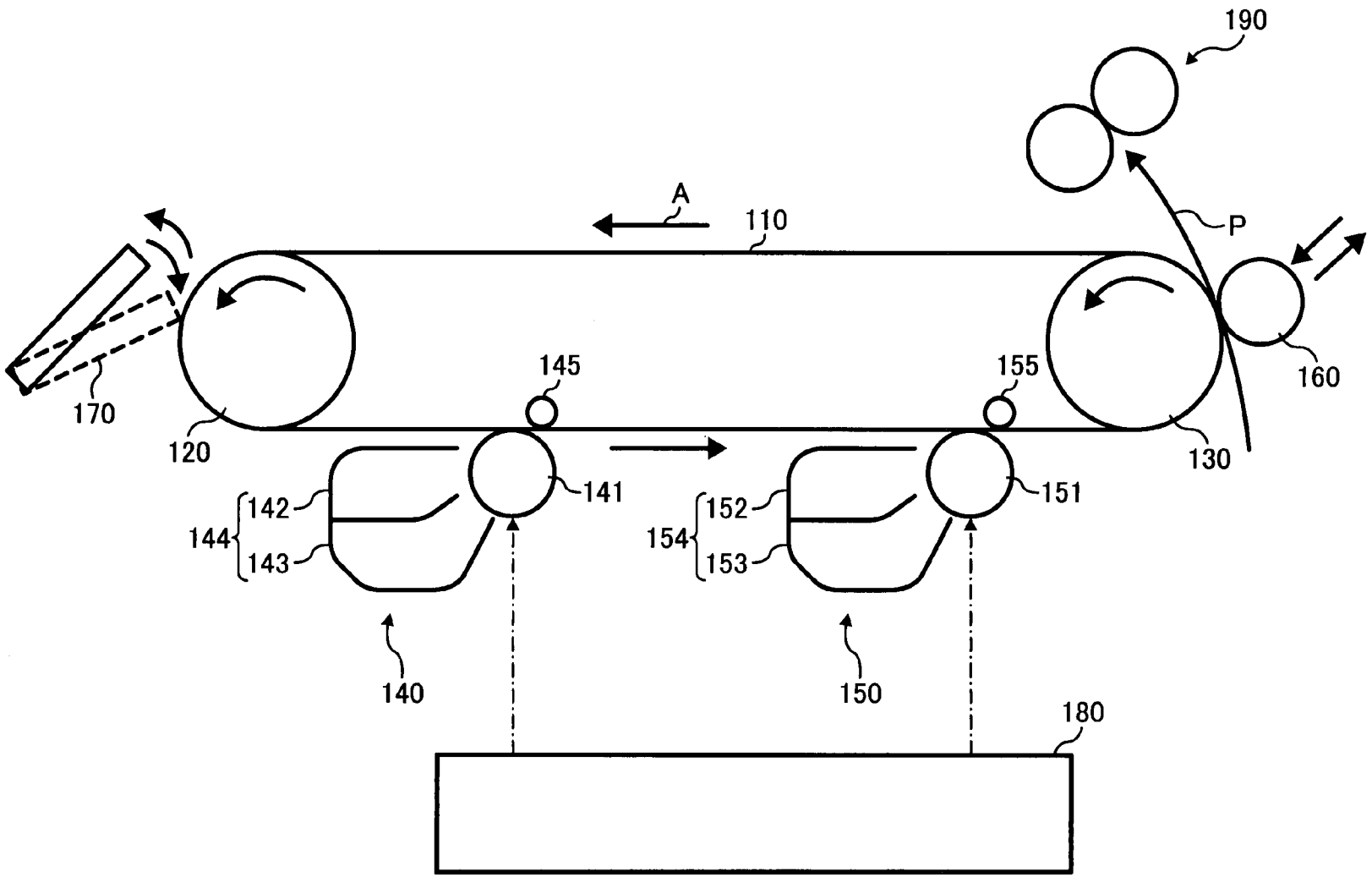
FIG. 1 is a schematic sectional view showing the schematic structure of a two-station type image forming apparatus to which an image forming apparatus of the present invention is applied.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus according to one embodiment of the present invention is explained.

FIG. 1 is a schematic sectional view showing the schematic structure of a two-station type image forming apparatus to which an image forming apparatus of the present invention is applied. The image forming apparatus of FIG. 1 typifies an intermediate transfer type color image forming apparatus in a two-station type recording system. In FIG. 1, an intermediate transfer belt 110 as an intermediate transfer medium is stretched over two opposing rollers 120 and 130 that are provided away from each other. The intermediate transfer belt 110 is rotated by these rollers 120 and 130. In addition, the intermediate transfer belt 110 is arranged in a vicinity of an image formation process mechanism which is described below. Assuming that the intermediate transfer belt 110 rotates in the direction of the arrow A, a first image station 140 and a second image station 150 are provided as the image formation process mechanism in this order from an upstream side in the belt rotation direction. Further, a transfer roller 160 as an image transferring mechanism is provided to contact with and to separate from the roller 130 across the intermediate transfer belt 110. In addition, a cleaning blade 170 is provided to contact with and to separate from the roller 120 across the intermediate transfer belt 110.

An image formation process of such an image forming apparatus is based on a general electrostatic recording system from the viewpoint of the first image station 140. In the dark, an optical wiring unit 180 writes an electrostatic latent image of a corresponding color onto a photosensitive member 141 uniformly charged with a charging mechanism (not shown). Then, a developing device 144 develops the electrostatic latent image as a visual image to transfer a toner image onto the intermediate transfer belt 110. Incidentally, the developing device 144 of the first image station 140 and a developing device 154 of a second image station 150 have visualizing functions using two different colors. Since four colors can be prepared by adding black to three primary colors, these four colors may be assigned to a corresponding one of a magenta developing device 142, a cyan developing device 143, a yellow developing device 152, and a black developing device 153 to form a full-color image.

Hence, the same image formation area of the intermediate transfer belt 110 passes sequentially through the two image stations 140 and 150 while being applied with a transfer bias voltage by transfer rolls 145 and 155 which serve as an intermediately-image-transferring mechanism and oppose the drum-like photosensitive members 141 and 151, respectively, to thereby multiply transfer toner images onto the intermediate transfer belt 110 for each color. The image area of the intermediate transfer belt 110 that has been multiply transferred with the two toner images of different colors is passed sequentially through the two image stations 140 and 150 again while being multiply transferred with toner images of colors different from the previous ones by each image station. In this way, after the same image formation area has passed through the image stations 140 and 150 again, a full-color toner image can be formed through the multiple transfer in the same image formation area.

Then, the formed full-color toner image is transferred onto a sheet P as a sheet-like medium. The transfer is carried out such that a transfer bias voltage is applied to a transfer roller 160 for a final transfer process which is brought into close contact with the roller 130 across the intermediate transfer belt 110 to pass the sheet P through a nip portion between the transfer roller 160 and the intermediate transfer belt 110. After the final transfer process, the full-color toner image formed on the sheet P is fixed by a fixing mechanism 190 to form the final full-color image on the sheet P.

Figure 2:
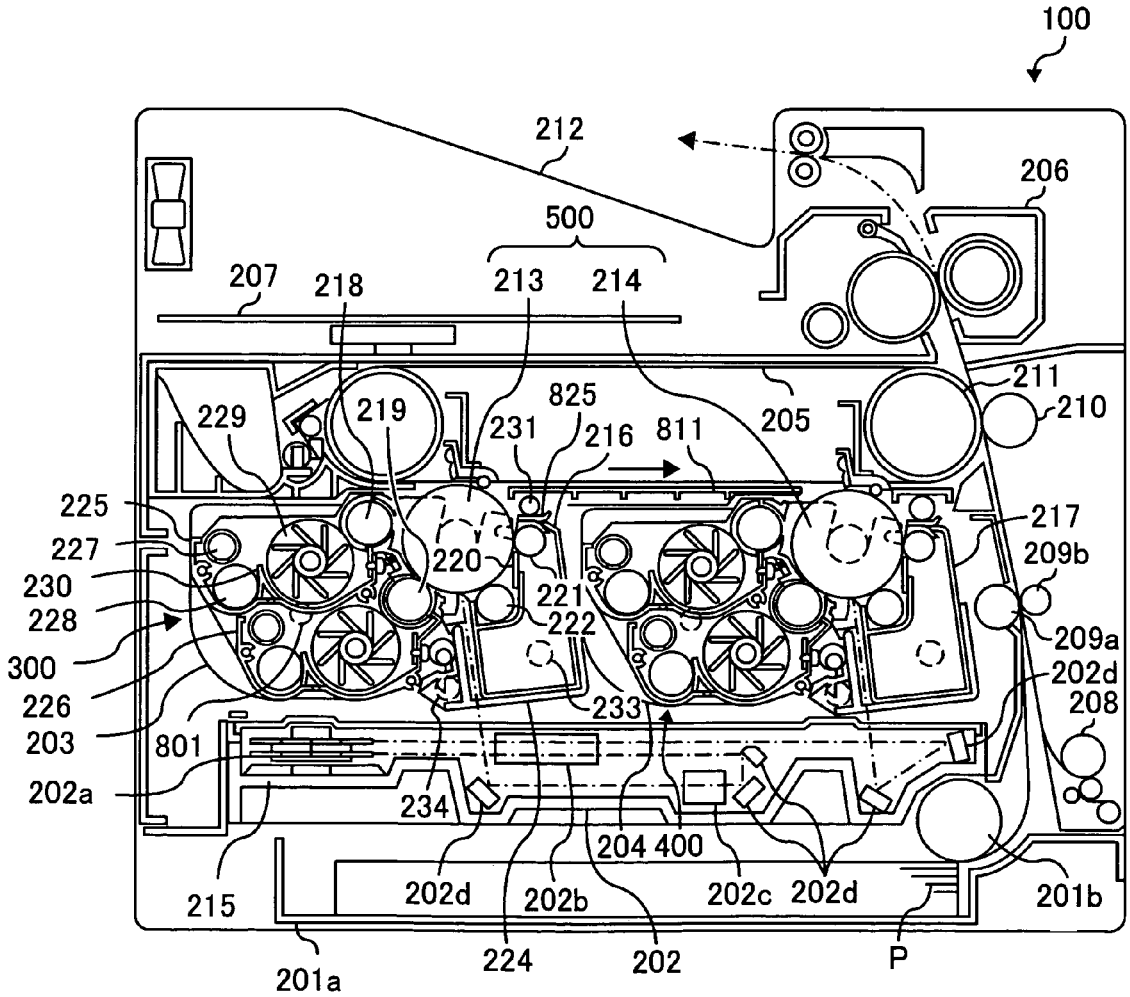
FIG. 2 is a sectional view showing the structure of an image forming apparatus according to an embodiment of the present invention.

FIG. 2 is a sectional view showing the structure of an image forming apparatus according to an embodiment of the present invention. The image forming apparatus of FIG. 2 is structured such that a transfer sheet holding unit 201*a*, a sheet feeing roll 201*b*, a wiring device 202, developing devices 203 and 204, an intermediate transfer belt 205 for intermediate transfer, a fixing mechanism 206, and an electrical system 207 are stacked in this order from the bottom. Further, a sheet conveying path including a manual feeding roller 208, registration rollers 209*a* and 209*b*, and a transfer roller 210 is provided substantially vertically, and passes through the transfer sheet holding unit 201*a* and the sheet feeding roll 201*b* and extends upward from a sheet transfer unit as a nip portion between the transfer rollers 210 and 211 towards a sheet discharging unit 212 through a fixing unit including the fixing mechanism 206.

The writing device 202 includes a laser optical system using a light source such as a semiconductor laser, an LED (light-emitting diode), or the like. The following drum-like photosensitive members 213 and 214 as image bearing members are exposed to light corresponding to image information. More specifically, two semiconductor lasers (not shown) apply laser beams corresponding to the image information to stacked polygon mirrors 202*a*. Then, the light reflected by the polygon mirrors 202*a* passes through scanning lenses 202*b* and 202*c*, and is reflected by reflection mirrors 202*d* and focused in exposure positions of the rotating photosensitive members 213 and 214.

Incidentally, each optical part is positioned and fixed to a housing 215 serving as a base of an apparatus main body casing. In this embodiment, a two-beam laser scanning system is used, but a writing method or structure is not limited thereto. In this embodiment, the wiring device 202 is provided below the photosensitive members 213 and 214. Thus, it is unnecessary to form an opening through which wiring light passes, in the housing 215 that supports the wiring device 202 from below the device. Thus, it is possible to improve the strength of the housing 215.

Next, a latent image forming and developing system mainly increases three cassettes or devices of a photosensitive cassette, a cleaning cassette (cleaning device), and a developing device, and the three cassettes and a sub side plate (not shown) supporting the developing device are incorporated into a unit to constitute the image station. The image station can be removably fixed to the apparatus main body. The photosensitive cassette and the cleaning cassette can be removably fixed to the sub side plate. Two image stations are prepared using the same members and provided in parallel on the right and left sides. In FIG. 2, a first image station 300 is provided on the left side and a second image station 400 is provided on the right side.

Further, the two photosensitive members 213 and 214 constitute a photosensitive cassette 500. In the photosensitive cassette 500, the two photosensitive members 213 and 214 are integrated into one unit so as to be collectively attached and removed. That is, one photosensitive cassette 500 is provided for the two image stations 300 and 400. The photosensitive cassette 500 can be attached to and removed from the two image stations 300 and 400. The integration of the two photosensitive members into a unit facilitates insertion of the photosensitive member at the time of setting a machine and replacement thereof. Further, unlike conventional process cartridges or image formation units, the other image forming mechanisms are not incorporated, so burdens on a user, a manufacturer, and environments can be alleviated. However, further alleviation of the burdens on the user, the manufacturer, and the environments is hindered by collective replacement of the two photosensitive members different in usable lifetime (discard of a serviceable photosensitive member). As a countermeasure against this, in the present invention, the photosensitive members are individually detachable to the unitized photosensitive cassette. To be specific, the first image station 300 and the second image station 400 include the developing devices 203 and 204, and cleaning cassettes 216 and 217, respectively, and share the detachable photosensitive cassette 500. Further, the photosensitive members 213 and 214 can be individually removed from and attached to the photosensitive cassette 500.

Figure 3:
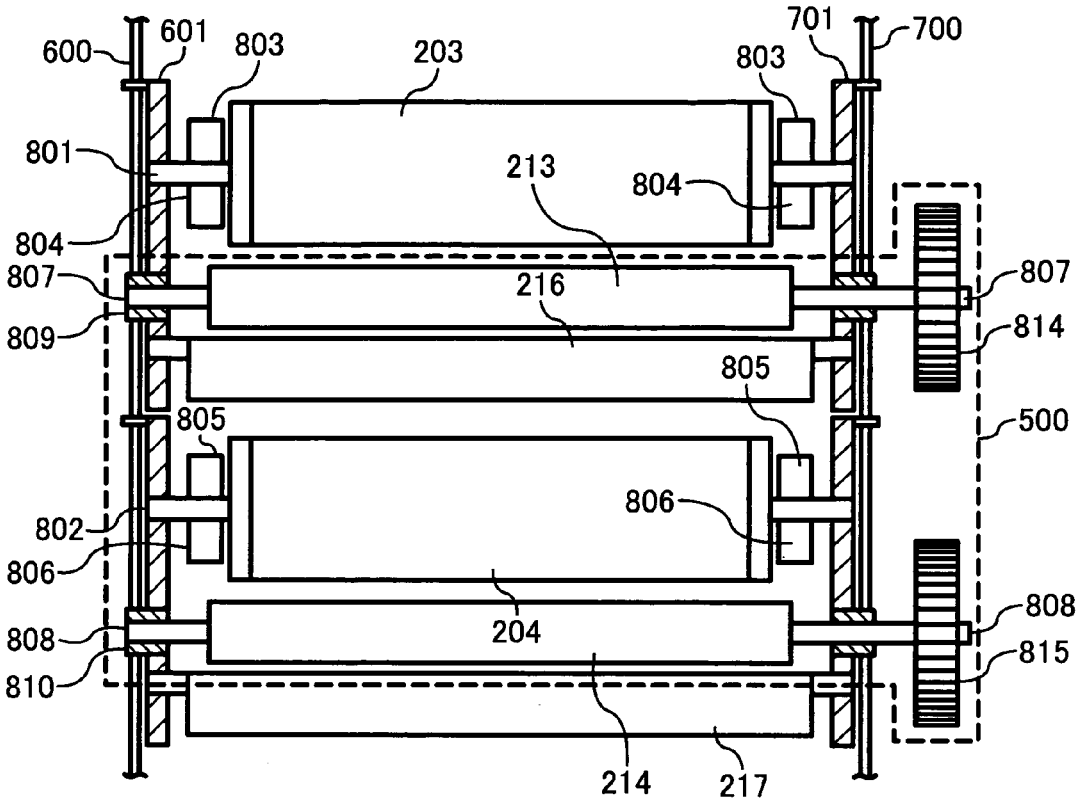
FIG. 3 is a plan view showing the schematic structure of an image station in the image forming apparatus according to the embodiment of the present invention.
Figure 4:
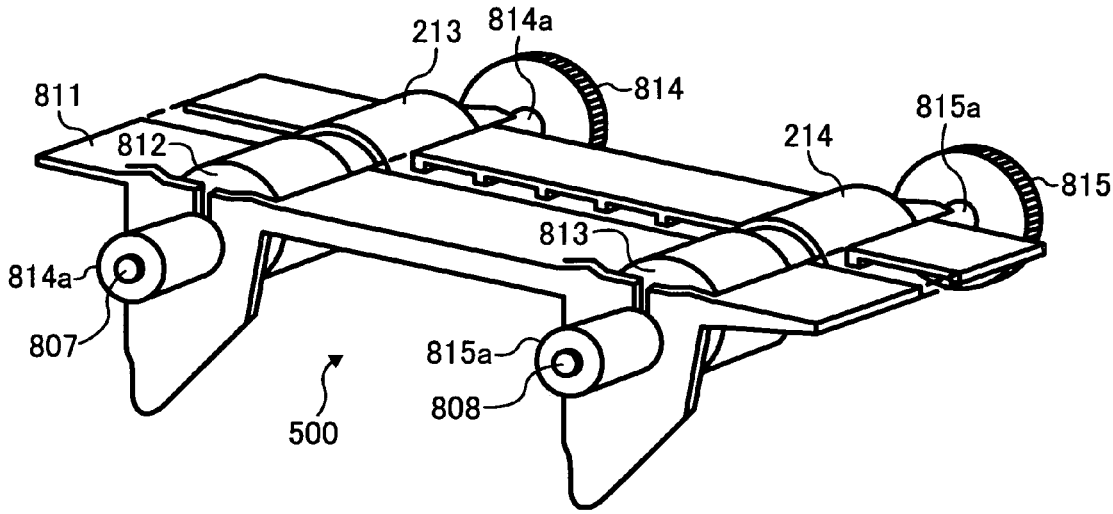
FIG. 4 is a perspective view showing the schematic structure of each photosensitive member in each image station.

FIG. 3 is a plan view showing the schematic structure of image stations of the image forming apparatus according to this embodiment. FIG. 4 is a perspective view showing the schematic structure of each photosensitive member of each image station. Incidentally, in FIGS. 3 and 4, the same components as those of FIG. 2 are denoted by like reference numerals. The plan view of FIG. 3 shows the schematic structure of the first image station 300 and the second image station 400 as viewed from above. Sub side plates 601 and 701 of each image station positioned in main body side plates 600 and 700 constituting the apparatus main body casing are coupled so as to keep predetermined interval and degree of parallelization with high dimensional accuracy, by a stay or a shaft (not shown).

Further, the developing devices 203 and 204 are rotatably supported and positioned by rotating shafts 801 and 802 inside the sub side plates 601 and 701. Thus, the developing devices 203 and 204 are integrated with the sub side plates 601 and 701. The size and shape of each of the sub side plates 601 and 701 are determined so as to cover a developing driving member such as a gear or a shaft or a developing component such as a toner replenishment port provided to side portions 803, 804, and 805, 806 of the developing devices 203 and 204. Further, the sub side plates 601 and 701 support the cleaning cassettes 216 and 217 such that the cassettes can be individually, rotated and removed/attached. The two photosensitive embers 213 and 214 are integrated into one unit to constitute the photosensitive cassette 500. The sub side plates 601 and 701 support the photosensitive cassette 500 such that the photosensitive members 213 and 214 can be rotated and removed/attached. Then, the sub side plates 601 and 701 are used to integrate the developing devices 203 and 204 and cleaning cassettes 216 and 217. The first image station 300 and the second image station 400 share the photosensitive cassette 500. The obtained first image station 300 and second image station 400 are set and fixed in positioning portions of the main body side plates 600 and 700, and a relative relationship therebetween is thus determined. The sub side plates 601 and 701 are detachable to the main body side plates 600 and 700 together with at least the developing deices 203 and 204.

As described above, the photosensitive cassette 500 includes a holder 811 that protects and integrates, and rotatably supports the photosensitive members 213 and 214, rotating shafts 807 and 808, and bearings 809 and 810. That is, unlike the conventional process cartridge or image forming unit, the photosensitive drums and other process mechanisms are not integrated. In addition, the plural photosensitive drums are not individually structured. That is, in the photosensitive cassette 500, the bearings 809 and 810 of FIG. 3 can be individually slid outwardly. The bearings are slid outwardly to expose the rotating shafts 807 and 808. As shown in FIG. 4, cut-out portions 812 and 813 having the diameter somewhat larger than the diameters of the rotating shafts 807 and 808 are formed in both side portions of the holder 811. The exposed rotating shafts 807 and 808 pass through the cut-out portions 812 and 813, so the photosensitive members 213 and 214 can be individually removed/attached. Thus, the photosensitive members 213 and 214 can be attached/detached to/from the holder 811.

Figure 5:
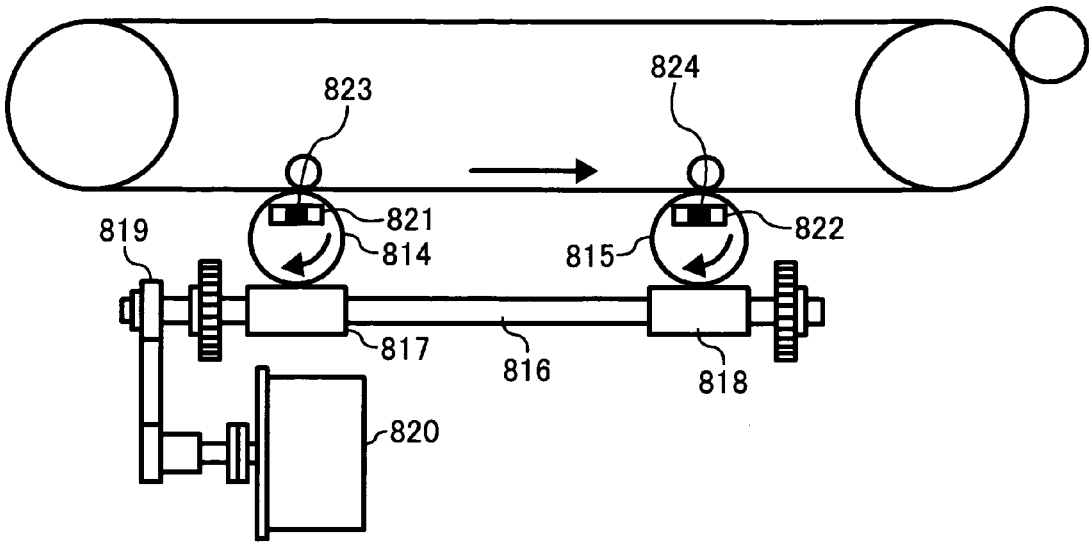
FIG. 5 is a schematic sectional view showing the outline of a driving mechanism of a photosensitive member.

As shown in the schematic diagram of a driving mechanism of the photosensitive members in FIG. 5, in the photosensitive members 213 and 214, gears 814 and 815 integrated with the rotating shafts 807 and 808 are engaged with worm gears 817 and 818 of a worm shaft 816. The worm shaft 816 is connected with a motor 820 provided to the image forming apparatus main body, through a pulley 819. Thus, the photosensitive members 213 and 214 are rotated in a clockwise direction that is the direction of the arrow of FIG. 5 by a driving torque of the motor 820. The gears 814 and 815 (or the photosensitive members 213 and 214 etc.) are formed of the same material with the same shape and quality. Identical positions on the outer side surfaces of the gears 814 and 815 are marked as marks 821 and 822. The marks 821 and 822 are put on the most eccentric positions of the gears 814 and 815. When the photosensitive members 213 and 214 are attached to the apparatus main body, the marks 821 and 822 are put in identical positions. For example, at the time of replacing the photosensitive member, the member is attached such that the marks 821 and 822 are put in upper positions. Hence, relative driving phases of the gears 814 and 815 are matched. Then, a speed difference between the photosensitive members 213 and 214 due to the eccentric gears 814 and 815 is eliminated to suppress color drift. Whether or not the marks 821 and 822 are put in identical positions is checked by sensors 823 and 824 for detecting the marks 821 and 822. At the time of setting a machine just after the purchase of the image forming apparatus, a new photosensitive cassette where photosensitive members marked in identical positions are integrated is attached to the apparatus main body, so no problem arises. At the time of replacing the photosensitive members, for example, replacing one of the photosensitive members, it is necessary to precisely match mark positions. If a user needs to execute this operation, the operation should be very easy. To that end, for example, whenever printing of an image in the image forming apparatus is completed to stop the photosensitive members and other driving units, the sensors 823 and 824 detect the marks 821 and 822 as shown in FIG. 5 to stop these components. In this way, the marks are always placed in predetermined positions (in FIG. 5, upper positions), so it is only necessary to attach a new photosensitive member to the photosensitive cassette while matching the mark positions. Hence, a user is free from a stress of positional alignment of the marks only by being given a message that "attach photosensitive member with mark being faced up". At this time, the sensors 823 and 824 automatically check whether or not the positions of the marks 821 and 822 are matched. If not matched, a user is notified of the misalignment on a display or the like of the apparatus main body and required to reattach the photosensitive member.

Further, in the first image station 300, as shown in FIGS. 2 and 3, the photosensitive cassette 500 is positioned with high accuracy relative to the sub side plates 601 and 701 that fix and support the developing device 203 including the developing rollers 218 and 219 with high positional accuracy. The same applies to the second image station 400. At the time of forming an image, the photosensitive members 213 and 214 of the photosensitive cassette 500 of this embodiment need to contact a developing or cleaning mechanism upon the image formation, and thus are exposed. If the removed photosensitive cassette 500 is placed outside the image forming apparatus at the time of replacing the photosensitive member, and the exposed portion contacts the floor or the like, there is a fear that the photosensitive members 213 and 214 are adversely affected. Thus, the photosensitive cassette 500 of this embodiment is structured as shown a schematic sectional view of FIG. 6 that shows the structure of the photosensitive cassette. The holder 811 has protrusions around the photosensitive members 213 and 214. Lines j-j, k-k, and n-n connecting tip ends of the protrusions extend outside the photosensitive members 213 and 214. With such structure, for example, even if the photosensitive cassette 500 is provided on the lines j-j, k-k, and n-n, the holder 811 protects the members, so the exposed portion of the photosensitive members 213 and 214 never contacts the floor. Hence, it is possible to improve the operability and prevent adverse influence on the photosensitive members 213 and 214.

Further, as shown in FIG. 2, in the first image station 300, the cleaning cassette 216 that supports the cleaning mechanism 220 and the charging device 221 is positioned relative to the photosensitive cassette 500 positioned with high accuracy to the sub side plates 601 and 701 of FIG. 3 to improve a relative positional relation among the photosensitive member 213, the cleaning mechanism including the cleaning blade 220 and a sealing roller 221, and a roller-like charging device 222. Further, the cleaning cassette can separately contact the photosensitive cassette such that the cleaning cassette 216 side is operated by the sub side plates 601 and 701.

In this way, the photosensitive cassette is structured as above, and the relation between the photosensitive cassette 500, and the cleaning cassette and the sub side plates 601 and 701 is set as above, so the photosensitive cassette 500 can be removed from the apparatus main body, and the photosensitive members 213 and 214 can be removed from the photosensitive cassette 500. Hence, the photosensitive members 213 and 214 can be solely replaced. That is, replacement timings of the photosensitive members 213 and 214 can be individually set based on each usable life. That is, the used component is only replaced, and a serviceable component is not replaced.

Further, the intermediate transfer belt or developing device, the cleaning device, and the charging device provided around the photosensitive member or components thereof are extremely close to or in contact with the photosensitive member. In this state, if the photosensitive cassette 500 is removed from the apparatus main body, there is a fear that not only the photosensitive member but also the devices or components provided closer to or in contact with the photosensitive member are damaged. In addition, an operability is too low. This holds true of the attachment to the apparatus main body. For example, in FIG. 2, when the photosensitive cassette 500 is pulled out frontward in FIG. 2 and thus removed from the apparatus main body, the photosensitive member is pulled out while being in contact with the intermediate transfer belt, the developing roller, the cleaning blade, and the charging roller of the first image station 300 and the second image station 400. Thus, in the present invention, in the case of attaching/removing the photosensitive cassette 500 to/from the apparatus main body, the devices or components around the photosensitive member are temporally separated from the photosensitive member whenever the photosensitive cassette is removed/attached, after which the photosensitive cassette 500 is removed/attached. At the time of attaching the cassette, the separated devices or components are restored to the original positions after the photosensitive cassette 500 is inserted. Thus, a positional relation therebetween is returned to the original one. The individual replacement of the photosensitive members 213 and 214 alone is described above. Furthermore, if the photosensitive cassette 500 alone can be removed from the image forming apparatus main body prior to the developing device or the cleaning cassette, the replacement of the photosensitive members 213 and 214 that require frequent replacements is facilitated. A process element to be replaced most frequently is the photosensitive members 213 and 214. During the frequent attachment/removal of the photosensitive cassette 500 and replacement of the photosensitive members 213 ad 214, removing the serviceable developing device or cleaning cassette together with the sub side plates 601 and 701 is troublesome and low in applicability, and causes another problem that a user's hand or surroundings get dirty. To overcome such drawbacks, in this embodiment, the used component alone is replaced, and the serviceable component is not removed as long as possible. Further, a component that would be more frequently replaced is preferentially removed. Incidentally, in this embodiment, the photosensitive members 213 and 214 have the drum shape, but may be structured in a belt shape.

Further, in the first image station 300, the cleaning cassette 216 includes a cleaning mechanism including the cleaning blade 220 as a cleaning member for removing residual toner or contaminants on the photosensitive member 213, and the sealing roller 221 for preventing the toner from being splashed at the time of cleaning, and the charging roller 222 for uniformly charging the photosensitive member 213 surface. These are integrated so as to surround the photosensitive member 213 with a waste toner recovery cleaning container 223 serving as a holder. Further, the sealing roller 221 and the charging roller 222 are rotatably supported to the cleaning container 223, and the connected wit the photosensitive member 213 by a gear train. As mentioned above, the driving force is transmitted by the gear 814 through the worm shaft 816 to rotate the photosensitive member. At the time of removing/attaching the photosensitive cassette 500, the gear train is disengaged. In order to minimize the wasteful replacement, the life periods of the charging roller 222 and the cleaning mechanism that would be worn and deteriorated are set almost equal in such a way that, for example, images can be printed on about 400 to 500 K sheets. The waste toner reservoir provided to the cleaning container 223 is set such that the waste toner is fully filled before the life of the charging roller 222 or the cleaning mechanism expires. The cleaning cassette 216 is housed and fixed to a cassette case 224 integrated with the sub side plates 601 and 701, so its position relative to the photosensitive cassette 500 and the photosensitive member 213 is determined with high accuracy.

In this way, the cleaning cassette 216 can be removed/housed from/to the cassette case 224 so as to be solely replaced. The cleaning cassette 216 is positioned and fixed by the sub side plates 601 and 701 similar to the photosensitive cassette 500, and can be solely removed/attached. Incidentally, the cassette 216 can separate from/contact with the photosensitive cassette 500, that is, the photosensitive member 213. The same holds true of the second image station 400.

To keep up with the recent tendency to downsize the image forming apparatus, or reduce the diameter of the photosensitive member, the cleaning cassette is accordingly provided around the photosensitive member, for example, in FIG. 2, provided in a space extending from the right side surface to the lower portion of the photosensitive member 213. The cleaning cassette occupies a wide area. Thus, for pulling out the cleaning cassette 216 upward, the photosensitive cassette 500 should be removed beforehand. In other words, in such a structure where the photosensitive cassette 500 is placed in a path along which the cleaning cassette 216 is to be removed, the image forming apparatus main body can be reduced, but in addition, the photosensitive member 213 to be most frequently replaced, that is, the photosensitive cassette 500 can be preferentially and easily removed. Further, the cleaning cassette 216 cannot be removed unless a correct operation procedure, for example, a process of removing the photosensitive cassette 500 first is executed. Accordingly, a user can determines which operation to execute, so an applicability is expected to improve. Further, a risk of replacing wrong parts or damaging the parts upon the replacement is eliminated.

As mentioned above, in the image forming apparatus where a user replaces expendables, how to facilitate the replacement or prevent erroneous replacement is most important, so an advantage of this embodiment that a user can clearly grasp what to do next is great.

Further, in the image forming apparatus of this embodiment, the photosensitive member or developing device is removable vertically to the rotational driving shaft. Thus, unlike the case of removing the device in the rotating axis direction, the photosensitive member never contacts the driving mechanism upon the attachment/removal, and image forming mechanism such as the photosensitive member can be removed/attached without being damaged. Further, the cleaning cassette is replaced by notifying a user that the waste toner is fully filled. In this embodiment, the charging roller 222 is used as the charging device, and the cleaning blade 220 and the sealing roller 221 are used as the cleaning meas. However, the present invention is not limited to the system, method, structure, material, etc. of these mechanisms. Further, the above applies to a cleaning-less cassette. Further, the sub side plates 601 and 701 are provided with the developing device 203 including the cyan developing device 225 and the magenta developing device 226 for developing the electrostatic latent image formed on the photosensitive member 213 using the developing rollers 218 and 219, and the cassette case 224 housing the cleaning set 216 for determining a position of the charging roller 222 and the cleaning mechanism relative to the photosensitive member 213. The side plates integrate these components Further, the photosensitive cassette 500 is positioned and fixed integrally with the sub side plates 601 and 701, and detachably and attahcably fitted and held therein.

Further, as for the cyan developing device 225 as a component of the developing device 2-3, cyan toner is supplied from the replenishment port 227 to one end of a transfer screw 229. The cyan toner supplied into the developing device by the transfer screw 229 is stirred in the direction opposite to the transfer direction by a paddle roller 220. During this process, the toner is supplied to the developing roller 218. The transfer screw 228 is separated from the paddle roller 229 across a partition wall 230. Incidentally, the same applies to the remaining developing device, the magenta developing device 226 as a component of the developing device 203 in order not to mix the toners different in moving directions. Further, the yellow developing device or the black developing device that constitutes the developing device 204 of the second image station 400 has the same structure except that the processed image color is different. Further, in the case of switching the color in the firs image station 300 or the second image station 400, while the photosensitive member is rotated, one of the cyan developing device 225 and the cyan developing device 226 switches a developing function to the other developing device to form a visual image on the photosensitive member using two colors in order. This method is classified into two: (a) a method using the electrical or magnetic force without changing the position of the image forming unit or the developing roller and (b) a method of changing the position of the device and the developing roller so as to separate from/contact with the photosensitive member. In this embodiment, at the time of removing the photosensitive cassette 500, the developing device and the developing roller are temporally separated from the photosensitive member, so in the case of using the method (a), a mechanism for physically separating the developing device and the developing roller from the photosensitive member is added, and in the case of using the method (b), the method (a) is used and the above mechanism is added, and both of the developing rollers are separated from the photosensitive member in such a neutral position that the rollers are separated from the photosensitive member.

Figure 7:
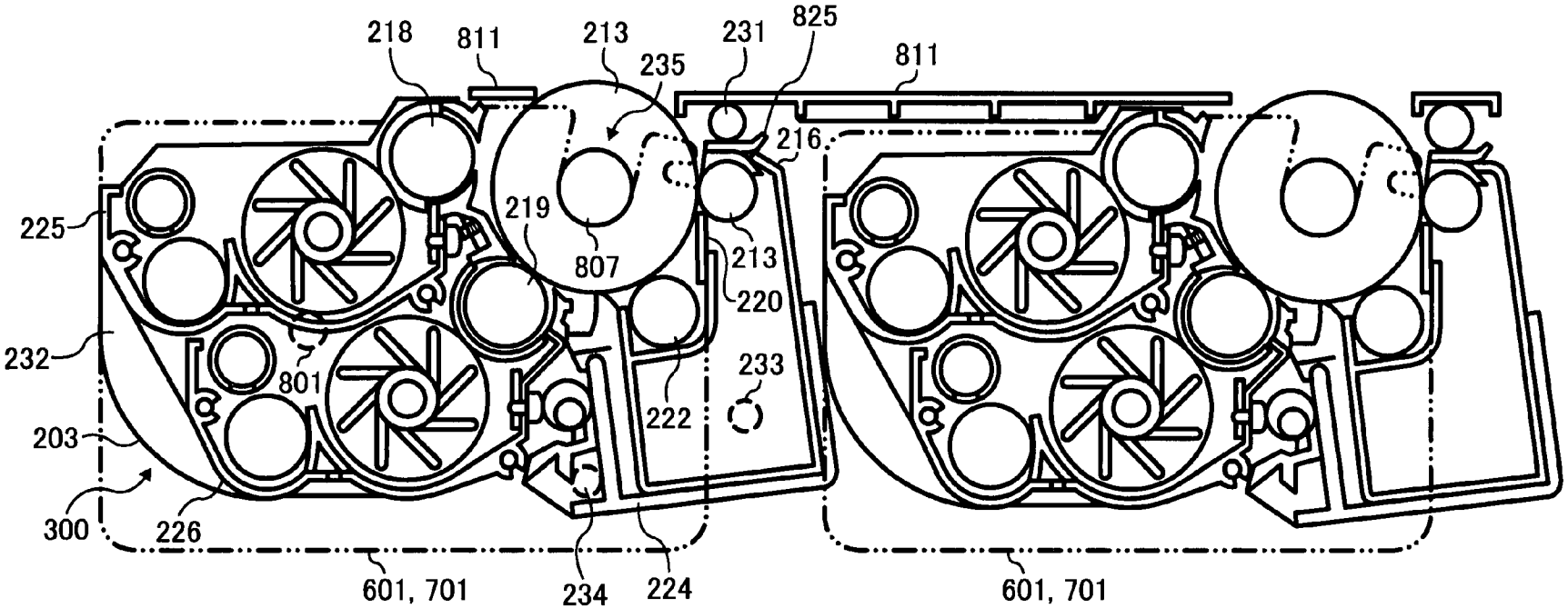
FIG. 7 is a schematic sectional view showing each image station attached and positioned in a reference setting position in an image forming apparatus main body according to the embodiment of the present invention.

FIG. 7 is a schematic sectional view showing each image station positioned and fixed in a reference setting position in the image forming apparatus main body of this embodiment.

In FIG. 7, in the first image station 300, image forming mechanism such as the charging roller 222, the cyan developing device 225, the magnet developing device 226, a quenching lamp 231, and the cleaning blade 220 are provided around the photosensitive member 213. The unit including the sub side plates 601 and 701 having these image forming mechanism, and the cassette case 224 is also referred to as an image forming unit main body. The developing unit side plate 232 supports the cyan developing device 225 and the magenta developing device 226 on both sides to form the developing device 203. The developing device 203 is rotatably supported by the rotating shaft 801 attached t the sub side plates 601 and 701 larger than the developing unit side plate 232. The sub side plates 601 and 701 support the developing device 203 as well as axially support the cassette case 224 rotatably around the shaft 234. Further, a semi-circular groove 235 extends above the sub side plates 601 and 701, and the rotating shaft 807 is fitted into the groove 235 (bearing 814*a* of FIG. 4) to position the photosensitive cassette 500. The cassette case 224 axially supports the holder 825 rotatably about the shaft 233. In this state, a detachment step of FIGS. 8 to 10 is carried out.

Figure 8:
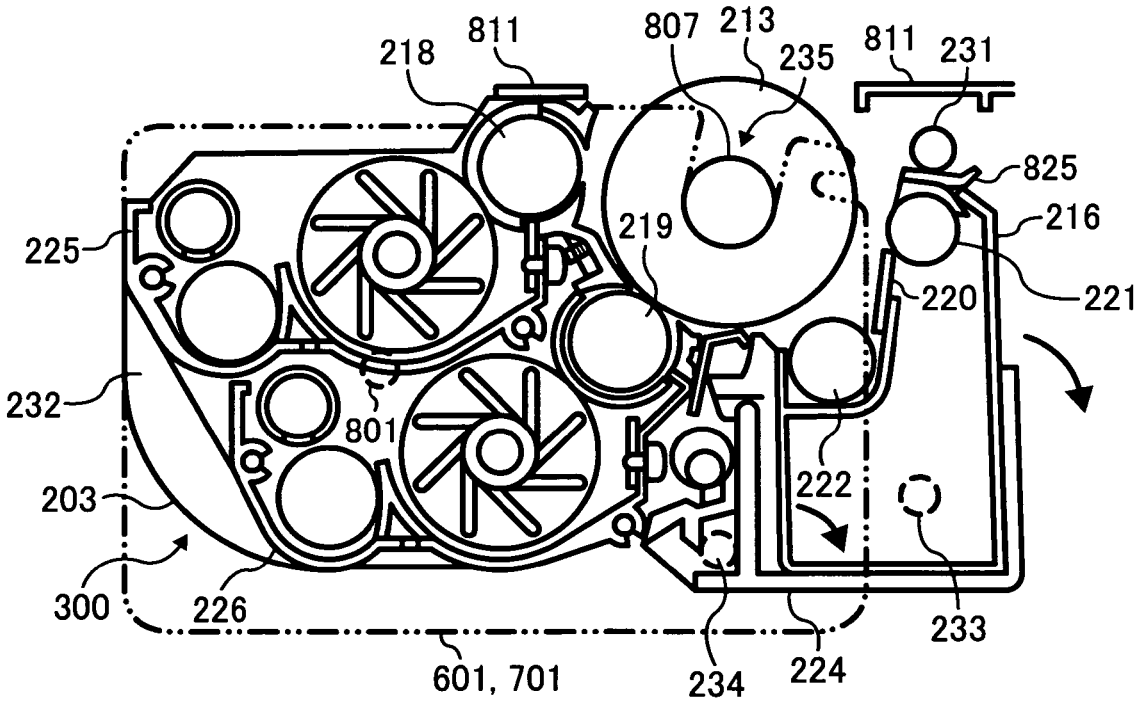
FIG. 8 is a schematic sectional view showing a detachment step.

First, as shown in FIG. 8, a lock mechanism (not shown) of the cassette case 224 is released, and then the cassette case 224 is turned to the right in the direction of the arrow about the shaft 234. As a result, the developing roller 222, the cleaning cassette 216 of the cleaning blade 220 of the cleaning mechanism, and the quenching lamp 231 are separated from the photosensitive member 213. Thus, the cleaning blade 220 in close contact, and the sealing roller 221 in contact are separated from the photosensitive member 213, so the photosensitive cassette 500 can be removed. As shown in FIG. 7, for example, under the normal attachment condition, the sealing roller 221 provided above the photosensitive member 213 and opposite t the developing roller 218 contacts the outer peripheral surface of the photosensitive member 213 in a position above an imaginary plane passing the centers of the developing roller 218 and the photosensitive member 213. Under this state, the photosensitive member 213 cannot be removed upward. Thus, it is necessary to separate the sealing roller 221 from the photosensitive member 213. In addition, the cleaning blade 220 is brought into close contact with the photosensitive member 213 from a counter direction, in the normal attachment position. Therefore, unless the blade is separated therefrom, the photosensitive member 213 cannot be attached/removed. In view of these, as shown in FIG. 8, the cassette case 224 is rotated about the shaft 234 to the right in the direction of the arrow beforehand. Likewise, the photosensitive member 219 should be separated from the developing rollers 218 and 210. Since one of the developing rollers 218 and 219 is always in contact or close contact with the photosensitive member 213, the photosensitive member 213 may be damaged or toner may spill from the developing roller if the photosensitive member 213 is removed/attached in this state. Accordingly, in this embodiment, the color is switched based on the above method (b). Further, the developing rollers 218 and 219 are moved away from the photosensitive member 213, that is, moved to a neutral position beforehand within a color switchable range of the developing devices 225 and 226. The way of separate the developing devices 225 and 226 from the developing rollers 218 and 219 is not limited to the above. In the case of increasing a distance between the developing devices 225 and 226 and the developing rollers 228 and 219, the developing devices 225 and 226 may be moved to the left of FIG. 8, for example. In the second image station 400, similar separating operation is executed. Unless the separating operation is carried out in both of the image stations, the photosensitive cassette 500 cannot be removed.

Figure 9:
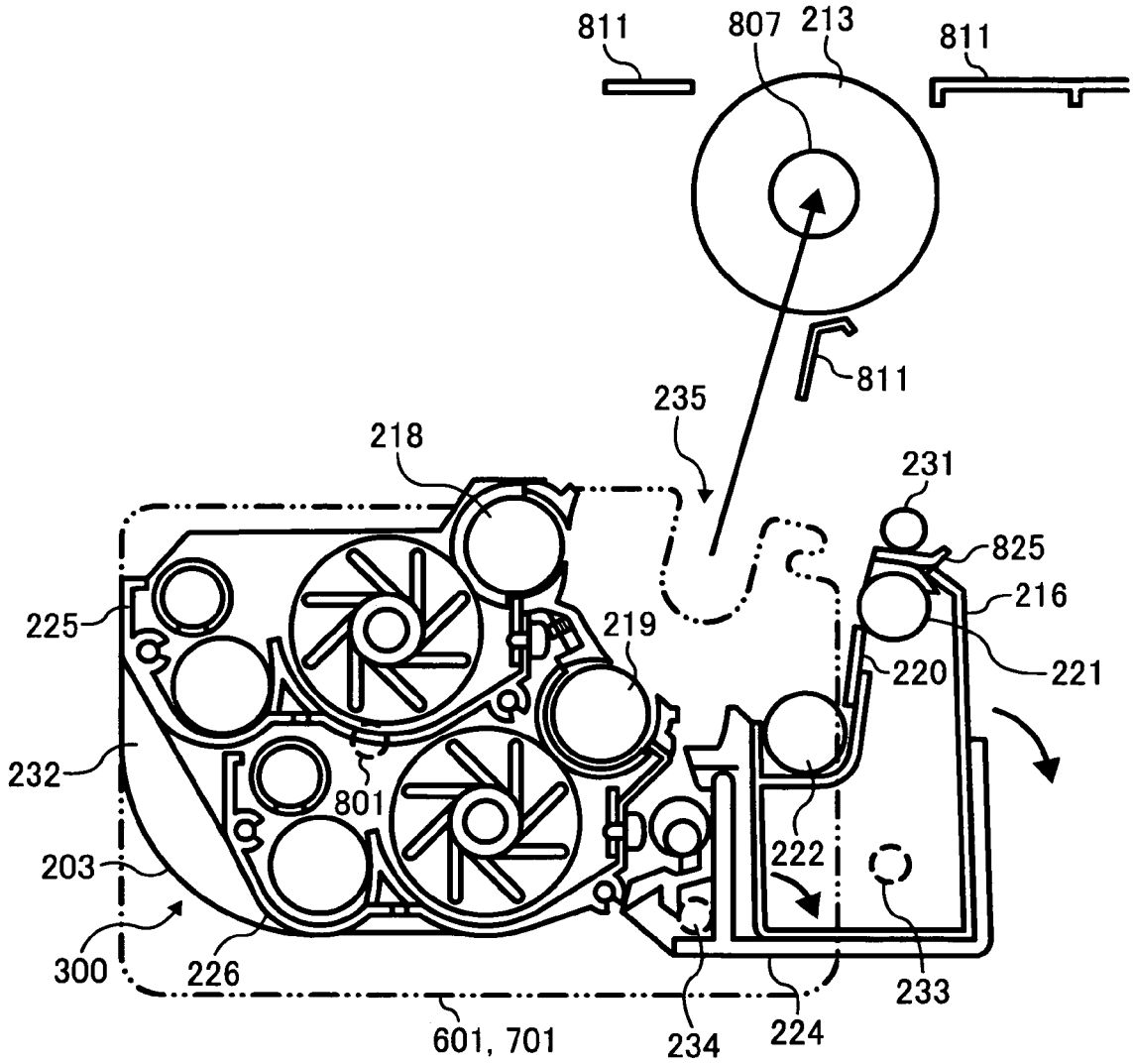
FIG. 9 is a schematic sectional view showing a detachment step.
Figure 10:
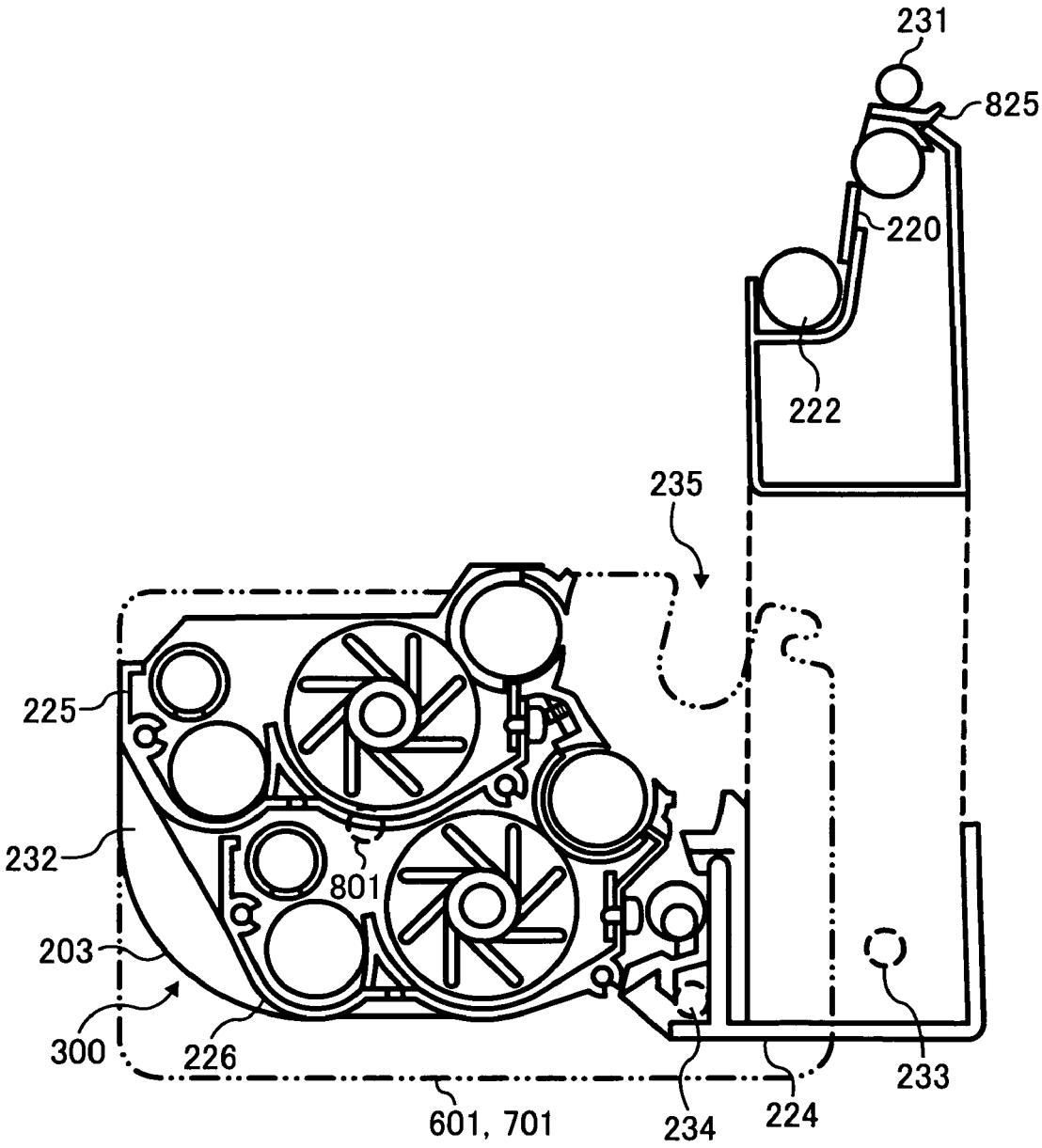
FIG. 10 is a schematic sectional view showing a detachment step.

Next, as shown in FIG. 9, the photosensitive cassette 500 is pulled out upward from the sub side plates 601 and 701 at the cut-out angle of the groove 235 formed above the sub side plates. If necessary, the holder 825 is rotated to the left about the shaft 233 to retract the quenching lamp 231 from the removal area of the cleaning cassette 216, after which as shown in FIG. 10, the cleaning cassette 216 is removed upward from the cassette case 224. In FIG. 10, a container of the cleaning cassette 218 is a box, and the cleaning blade 220 and the lower portion of the sealing roller 221 define a sealed space. This space serves as a waste developer container 236 that contains waste toner. A waste developer scraped off by the cleaning blade 220, in this embodiment, the waste toner is recovered to the waste developer container 236. The cleaning cassette 216 is integrated with the waste developer container 236 and can be removed/attached to the cassette case 224, that is, can be removed/attached to the sub side plates 601 and 701. Accordingly, when the waste developer container 236 is filled up with waste toner, the entire cleaning cassette 216 ire replaced or only the waste toner is disposed of to recycle the cleaning cassette 216.

Figure 6:
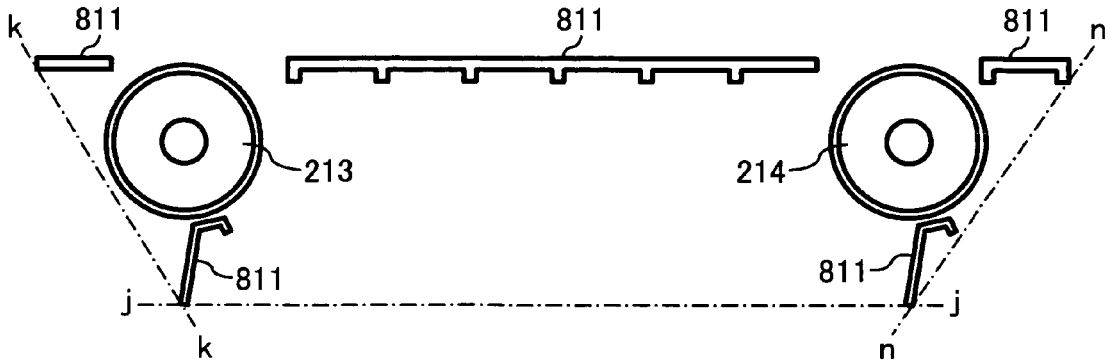
FIG. 6 is a schematic sectional view showing the structure of a photosensitive cassette.

As shown in FIG. 9, the removed photosensitive cassette 500 is place on the table as shown in FIG. 4 or 6. At this time, phase-matching marks 821 and 822 of the gears 814 and 815 of the photosensitive members 213 and 214 as shown in FIG. 5 are positioned in identical upper positions. Then, a used photosensitive member out of the photosensitive members is pulled out from the holder 811 (by sliding bearing 814*a* or 815*a*) to replace the used one with a new photosensitive member. At the time of attaching the new photosensitive member, the new photosensitive member is attached to match a phase-matching mark position with that of the unreplaced one. If both of the photosensitive members should be replaced at a time, both of them may be replaced, but in this case, the positional alignment of the marks is troublesome and requires much time. Thus, in this case, it is efficient to replace the photosensitive cassette with a new cassette including the mark-adjusted photosensitive members, and thus a user never gets his/her hands dirty.

Figure 11:
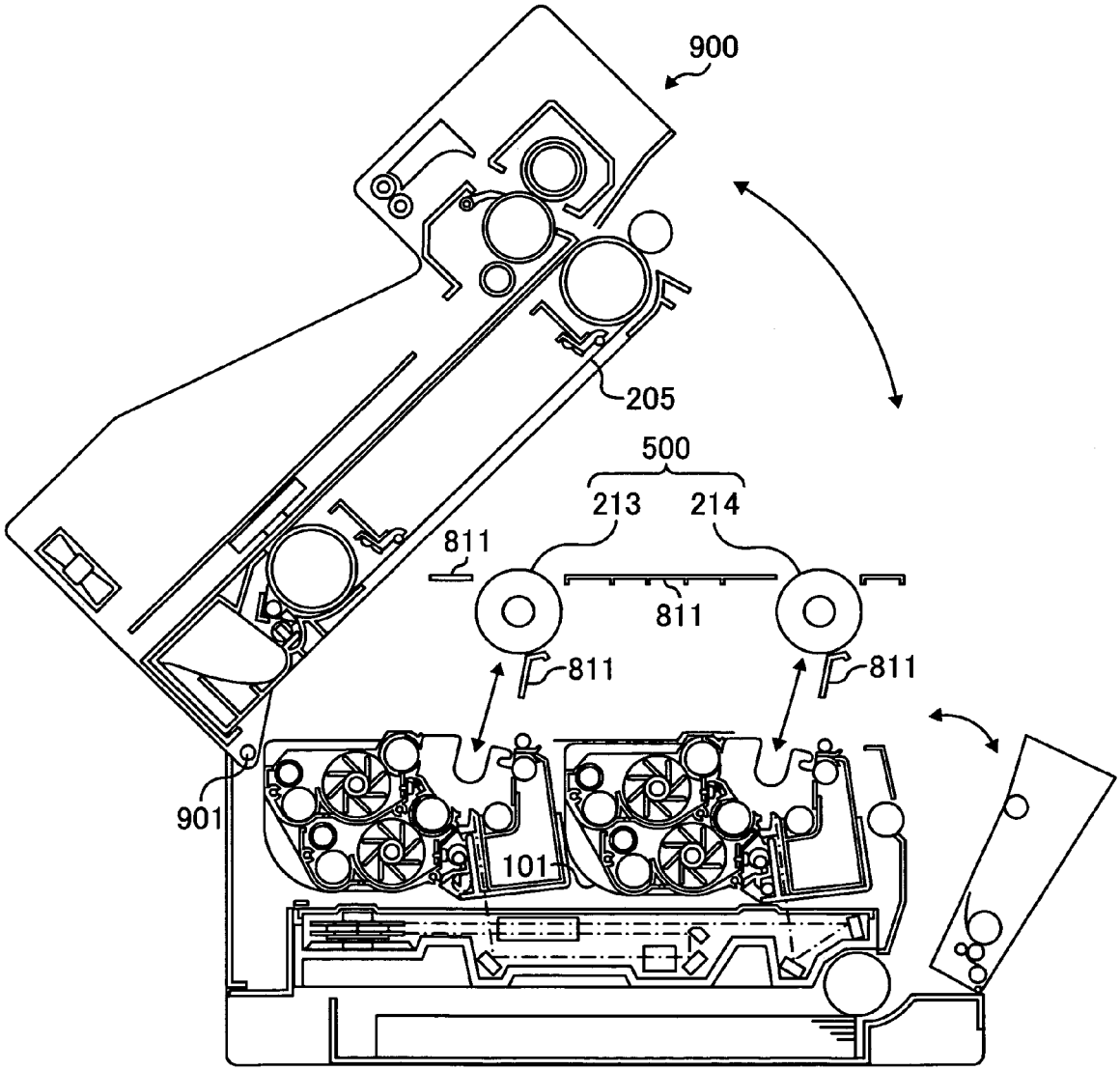
FIG. 11 is a schematic sectional view showing how a photosensitive cassette is replaced in the image forming apparatus according to the embodiment of the present invention.

FIG. 11 is a schematic sectional view showing how the photosensitive cassette is replaced in the image forming apparatus of this embodiment. In FIG. 11, an upper casing 900 is rotated about a shaft 901 to the left to separate the intermediate transfer belt 205 from the photosensitive members 213 and 214 to remove/attach the photosensitive cassette 500.

Figure 12:
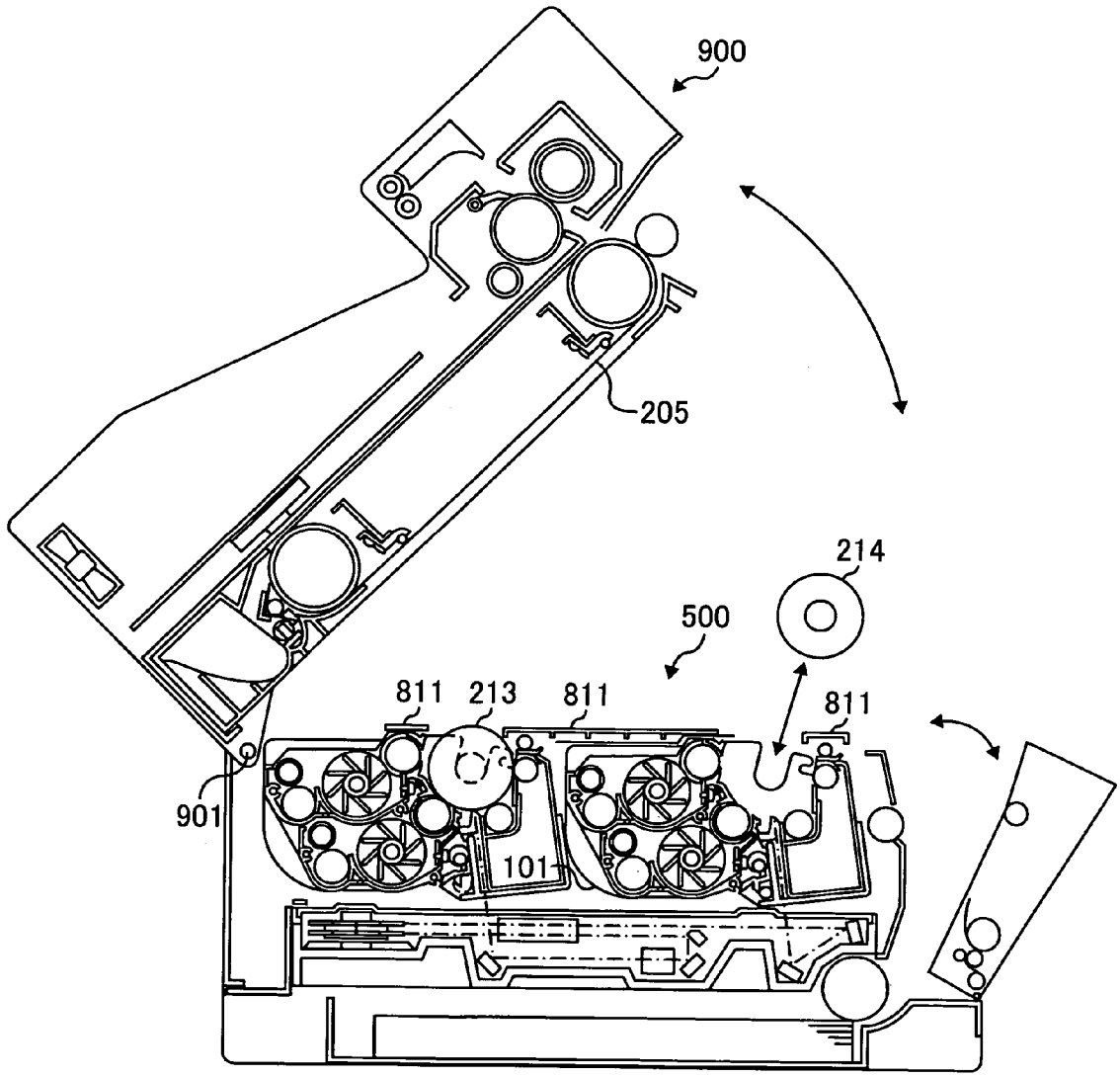
FIG. 12 is a perspective view showing the schematic structure of each photosensitive member in each image station for individually attaching/detaching photosensitive members to/from a photosensitive cassette.
Figure 13:
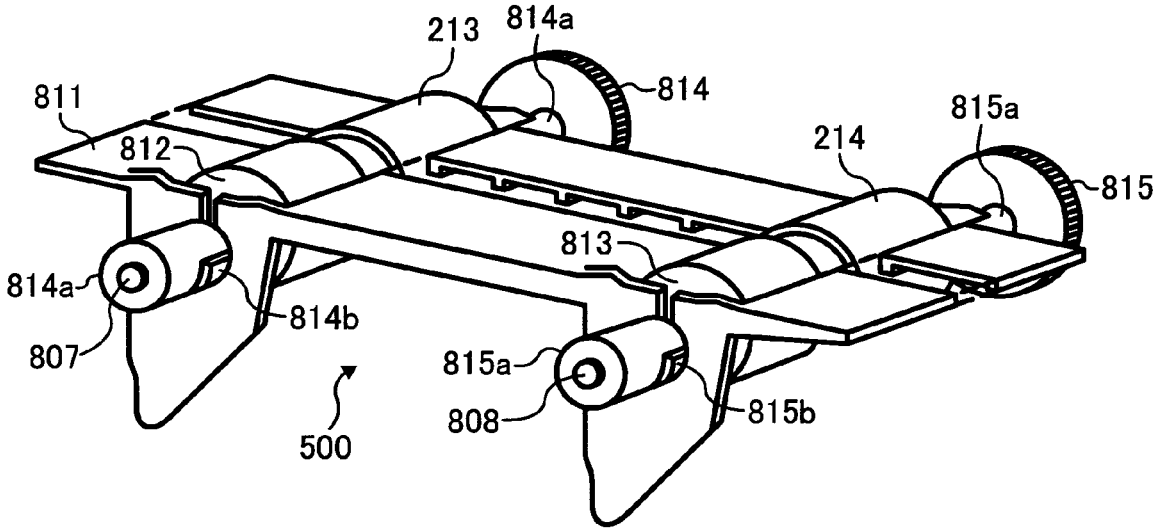
FIG. 13 is a perspective view showing another schematic structure of each photosensitive member in each image station.

Further, in this embodiment, in order to improve the operability in individual attachment/removal of the photosensitive members to/from the photosensitive cassette 500, even if the photosensitive cassette 500 is attached to the apparatus main body, the photosensitive members can be individually removed/attached. In this case, however, after the photosensitive members are removed, the photosensitive cassette 500 needs to be positioned in the first image station 300 and the second image station 400. The photosensitive cassette 500 of FIG. 4 is structured such that the sub side plates 601 and 701 are supported to the bearing of the photosensitive member, so if the photosensitive member alone is removed as shown in FIG. 12, the holder 811 not supported cannot keep its posture. To that end, in order to enable the individual attachment/removal of the photosensitive member in the state where the photosensitive cassette 500 is attached, the protrusions 814*a* and 815*a* concentric with the bearings 814*a* and 815*a* of the photosensitive members 213 and 214 are formed on the side surfaces of the holder 811 as shown in FIG. 13. The inner diameter thereof is set to receive the bearings 814*a* and 815*a* of the photosensitive member, and the outer diameter thereof is set within a range of the sub side plates 601 and 701. Accordingly, the holder 811 is supported to the sub side plates 601 and 701, and the photosensitive members 213 and 214 are supported to the holder 811, so even if the photosensitive member is removed from the photosensitive cassette 500, the holder 811 can keep its posture inside the apparatus main body.

In this case as well, the process for matching phases of the gears of the photosensitive member is the same as above. Further, the way to retract and separate the intermediate transfer belt, the developing mechanism, the cleaning mechanism, and the charging mechanism are the same as above at the time of removing/attaching the photosensitive member.

Incidentally, in this embodiment, mechanisms for fixing or unfixing the sub side plates to/from the apparatus main body, mechanisms for fixing or unfixing the photosensitive cassette to/from the sub side plates, or the like have no particular function and structure, and thus are omitted. A general lock mechanism may be used. As regards the attachment/removal of the photosensitive member to/from the holder of the photosensitive cassette is described using an example of sliding the bearing of the photosensitive member, but the present invention is not particularly limited thereto and an appropriate mechanism may be adopted. Further, the embodiment of the present invention describes the two photosensitive members, but the present invention is not limited thereto, and is applicable to any image forming apparatus using plural photosensitive members.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent application, No. JPAP2005-050807 filed on Feb. 25, 2005 in the Japanese Patent Office, the entire contents of which are incorporated by reference herein.

What is claimed as new and desired to be secured by Letters Patent of the United States is:

1. An image forming apparatus, comprising:

a plurality of image carrying members each configured to form and carry a toner image;

an image carrier holder configured to rotatably hold the plurality of image carrying members and to allow each of the plurality of image carrying members to be independently removed therefrom; and an image carrier cassette configured to include the plurality of image carrying members and the image carrier holder, and to be detachably installed to the image forming apparatus, wherein the image carrier holder has protrusions around the plurality of image carrying members, and ends of the protrusions extend beyond the plurality of image carrying members, wherein the image carrier cassette allows each of the plurality of image carrying members to be independently removed therefrom and attached thereto under a condition that the image carrier cassette is installed in the image forming apparatus.

2. An image forming apparatus, comprising:

a plurality of image carrying members each configured to form and carry a toner image;

an image carrier holder configured to rotatably hold the plurality of image carrying members and to allow each of the plurality of image carrying members to be independently removed therefrom;

an image carrier cassette configured to include the plurality of image carrying members and the image carrier holder, and to be detachably installed to the image forming apparatus; and a plurality of image forming components arranged at respective predetermined fixing positions around each one of the plurality of image carrying members, wherein the image carrier holder has protrusions around the plurality of image carrying members, and ends of the protrusions extend beyond the plurality of image carrying members, wherein the image carrier cassette is removable from the image forming apparatus after at least one of the plurality of image forming components is moved away from the predetermined fixing position.

3. The image forming apparatus according to claim 2, wherein the image carrier cassette allows each of the plurality of image carrying members to be independently removed therefrom and attached thereto under a condition that the image carrier cassette is in a state detached from the image forming apparatus.

4. The image forming apparatus according to claim 3, wherein the image carrier cassette is re-installable into the image forming apparatus under a condition that the at least one of the plurality of image forming components is moved away from the predetermined fixing position.

5. The image forming apparatus according to claim 4, wherein the at least one of the plurality of image forming components is reset to the predetermined fixing position when the image carrier cassette is reinstalled into the image forming apparatus.

6. An image forming apparatus, comprising:

a plurality of image carrying members each configured to form and carry a toner image;

an image carrier holder configured to rotatably hold the plurality of image carrying members and to allow each of the plurality of image carrying members to be independently removed therefrom;

an image carrier cassette configured to include the plurality of image carrying members and the image carrier holder, and to be detachably installed to the image forming apparatus; and a plurality of image forming components arranged at respective predetermined fixing positions around each one of the plurality of image carrying members, wherein the image carrier holder has protrusions around the plurality of image carrying members, and ends of the protrusions extend beyond the plurality of image carrying members, wherein each of the plurality of image carrying members is removable from and attached to the image carrier holder of the image carrier cassette after at least one of the plurality of image forming components is moved away from the predetermined fixing position under a condition that the image carrier cassette is in a state installed in the image forming apparatus.

7. The image forming apparatus according to claim 6, wherein the at least one of the plurality of image forming components is reset to the predetermined fixing position when each of the plurality of image carrying members is reinstalled to the image carrier holder of the image carrier cassette.

* * * * *